US011506351B1

(12) United States Patent
Guo

(10) Patent No.: US 11,506,351 B1
(45) Date of Patent: Nov. 22, 2022

(54) HIGHLY SIMULATED ELECTRONIC CANDLE

(71) Applicant: Chang Zhou Man Mei Industrial Co., Ltd., Changzhou (CN)

(72) Inventor: Lei Guo, Changzhou (CN)

(73) Assignee: Chang Zhou Man Mei Industrial Co., Ltd., Changzhou (CN)

( * ) Notice: Subject to any disclaimer, the term of this patent is extended or adjusted under 35 U.S.C. 154(b) by 0 days.

(21) Appl. No.: 17/702,673

(22) Filed: Mar. 23, 2022

(51) Int. Cl.
*F21S 10/04* (2006.01)
*F21V 23/04* (2006.01)
*F21S 9/02* (2006.01)

(52) U.S. Cl.
CPC ..... *F21S 10/043* (2013.01); *F21S 9/02* (2013.01); *F21V 23/04* (2013.01)

(58) Field of Classification Search
CPC ..... F21S 10/043; F21S 6/001
See application file for complete search history.

(56) References Cited

U.S. PATENT DOCUMENTS 8,602,610 B1 * 12/2013 Lauer ..... F21V 9/40 362/386
11,118,746 B1 * 9/2021 Cao ..... F21S 10/046
2007/0014107 A1 * 1/2007 Mishan ..... F21S 10/04 362/190
2007/0236948 A1 * 10/2007 Restell ..... F21L 27/00 362/183
2008/0074875 A1 * 3/2008 Jensen ..... F21S 6/001 362/240
2009/0067164 A1 * 3/2009 Ambroggio ..... C11C 5/008 362/161
2012/0307516 A1 * 12/2012 Ding ..... F21S 6/001 362/84
2015/0124474 A1 * 5/2015 Ding ..... G02B 6/0008 362/569
2016/0290579 A1 * 10/2016 Au ..... F21S 6/001
2019/0032904 A1 * 1/2019 Wang ..... F21S 6/001

* cited by examiner

*Primary Examiner* — Bryon T Gyllstrom
*Assistant Examiner* — Christopher E Dunay
(74) *Attorney, Agent, or Firm* — Bayramoglu Law Offices LLC

(57) ABSTRACT

A highly simulated electronic candle includes a simulated casing, a battery holder, a circuit board, a wick wire, and a flame front. A top of the simulated casing is depressed downwards to form a first groove, and an epoxy resin is injected into the first groove to form a simulated wax oil layer. The battery holder is arranged at an inner bottom end of the simulated casing. The circuit board is electrically connected to the battery holder. The wick wire is electrically connected to the circuit board and extending upwards through the simulated wax oil layer. The flame front is fixedly connected to a top end of the wick wire. The highly simulated electronic candle has a high simulation degree, simulates a wax oil dripping or a flame reflection of a real candle after burnt.

8 Claims, 6 Drawing Sheets

HIGHLY SIMULATED ELECTRONIC CANDLE

TECHNICAL FIELD

The present invention relates to the field of electronic candle lamps, in particular to a highly simulated electronic candle.

BACKGROUND

At present, in various occasions, traditional candles are gradually replaced with electronic candle lamps. The traditional candles are consumables and have open flames, which are extremely dangerous. The flames of the traditional candles are replaced with luminous bodies of the electronic candle lamps, which can not only avoid the dangers of the traditional candles, but also save resources.

The existing electronic candles have low simulation degree, mainly in the following three aspects:

1) When the candle is burning, a wick is black after carbonization due to incomplete burning. The patent application No. 2017102098436 discloses an electronic candle, which only uses a wire to simulate the wick, and does not consider the blackening of the wick caused by carbonization after burning. The electronic candle is large in degree of distortion and not suitable for promotion.

2) When the candle is burning, due to the higher temperature near the flame, wax oil at this place will melt to form a fluid. The place where the candle is used is generally relatively dim, so the flame will be reflected at the place where the wax oil accumulates. The Chinese application No. 201720951183.4 discloses an "electronic candle lamp housing and an electronic candle lamp". Although it is taken into consideration that a groove is formed in the upper end of the candle lamp housing, it does not simulate the dripping of wax oil for the groove.

3) When the candle is burning, the internal flame thereof will show a blue flame core due to the higher temperature. The existing electronic candles only use flame sheets or a single mono-color LED lamp to simulate flame combustion, which is poor in simulation effect and not high in simulation degree.

In addition, an electronic part of the electronic candle generally consists of a power supply, an electronic circuit that controls the functions including the flickering and timing of the electronic candle, remote control and the like, and one or more LED lamp beads. In the prior art, the electronic candle is driven by two 2XAA batteries, with a battery voltage of 1.5V, and a capacity of 1500 mA. The batteries are in a series structure, the voltage is 3V after the series connection, and the capacity is still 1500 mA. After a switch is turned on to energize the electronic candle circuit, the LEDs are controlled by the control circuit to realize the corresponding functions. However, the LEDs in this type of products need more than 2V-2.4V driving voltage to work and glow, and a main control chip in the electronic circuit also needs more than 2.2V working voltage, so the electronic candles on the market cannot work normally when the voltage of the battery is depleted to only about 2V. Therefore, the battery of the electronic candle in the prior art has a short service life, needs to be replaced frequently, wastes the battery capacity, and is high in use cost.

SUMMARY

In order to solve the existing technical problems above-mentioned, the present invention provides a simulated electronic candle with high simulation degree.

To solve the technical problems above-mentioned, the present invention uses the following technical solution.

A highly simulated electronic candle includes:

a simulated casing, internally provided with a first cavity, where the top of the simulated casing is depressed downwards to form a first groove, and a simulated wax oil layer is arranged in the first groove;

a bracket assembly, arranged at the bottom of the first cavity, where a battery holder with a circuit board is arranged in the first cavity, and the battery holder is electrically connected to the circuit board;

a wick conduit, arranged on the top of the battery holder and extended upwards through the simulated wax oil layer, where a wick wire is accommodated in the wick conduit, and the wick wire passes through the wick conduit and is electrically connected to the circuit board;

a booster circuit with a booster chip, connected into the circuit controlled by the circuit board;

an extension part of the wick conduit passing through the simulated wax oil layer is covered with a simulated burnt layer, where the outer surface of the simulated burnt layer has wrinkles; and a flame front, arranged at the top of the wick conduit, where a luminous body electrically connected to the wick wire is accommodated in the flame front.

Further, a first connecting piece is fixed to the inner side wall of the first cavity;

the bracket assembly includes a bottom plate and a second connecting piece perpendicular to the bottom plate, the bottom plate is fixedly connected to the first connecting piece, the second connecting piece is fixedly connected to the battery holder, the battery holder includes a second cavity, and the second cavity is provided with a conductive spring at the inner top end and a conductive gasket at the bottom; and the other side of the battery holder is provided with a slot, the slot accommodates the circuit board, and the circuit board is electrically connected to the conductive spring.

Further, a switch channel is formed in the bottom plate, the switch channel is communicated with the second cavity, and a plastic sheet for switching the battery holder is arranged in the switch channel.

Further, the top of the simulated casing has an undulating edge.

Further, the simulated wax oil layer is made of an epoxy resin material, and the upper surface of the simulated wax oil layer is flat or has undulating ripples.

Further, the side surface of the simulated casing is depressed inwards to form a second groove.

Further, the outer surface of the second groove is provided with an anti-slip sticker or an anti-slip groove.

Further, the outer layer of the part of the bottom of the flame front corresponding to the luminous body is provided with a light blue plastic band or coated with a light blue paint layer.

Therefore, compared with traditional technical means, an electronic music candle of the present invention has the following beneficial effects:

1. The present invention has a high simulation degree, simulates the wax oil dripping after burnt or flame reflection of a real candle, simulates the black part of the wick of the real candle after burnt, and simulates a blue flame core that occurs during the burning of the real candle, which more conforms to reality.

2. The present invention utilizes the simulated casing depressed inwards, which is convenient for a user to grasp, and is also not easy to fall.

3. The booster circuit with the booster chip is connected into the control circuit of the circuit board, such that the working voltage can be held above the working voltage for a longer time, and the battery has high efficiency and long service life.

BRIEF DESCRIPTION OF THE DRAWINGS

Through the following detailed descriptions in conjunction with the accompanying drawings, the foregoing and other objectives, features and advantages of the present invention will become apparent.

In the drawings.

Figure 1:
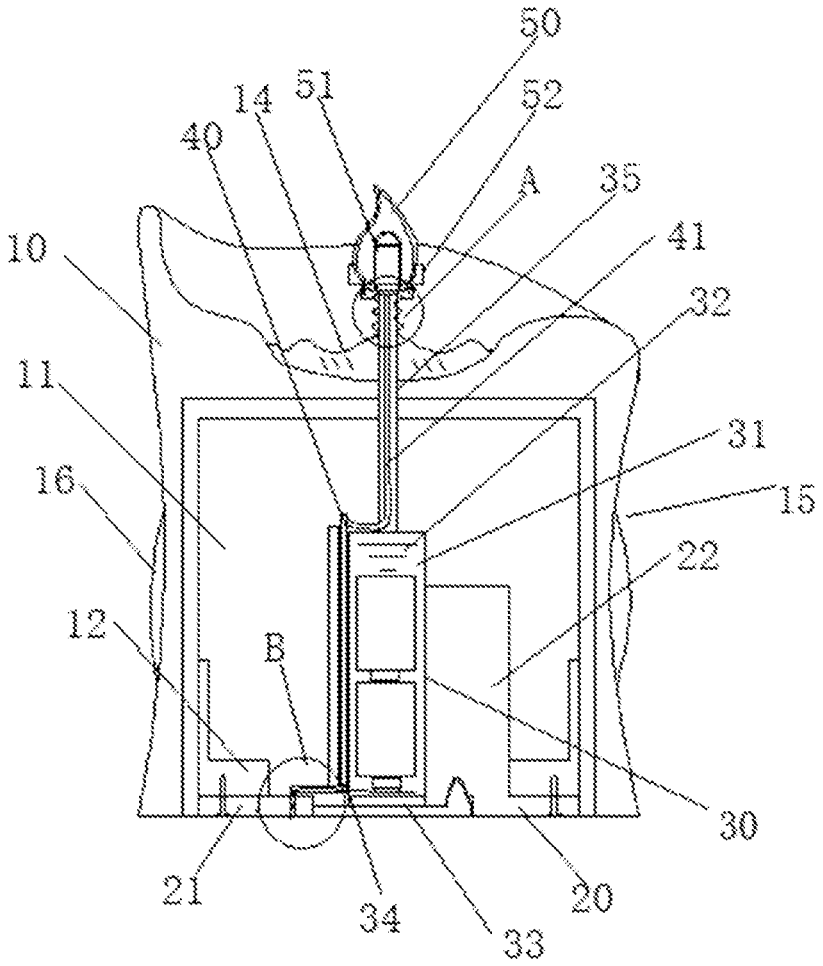
FIG. 1 illustrates a schematic cross-section structural diagram of the present invention.
Figure 2:
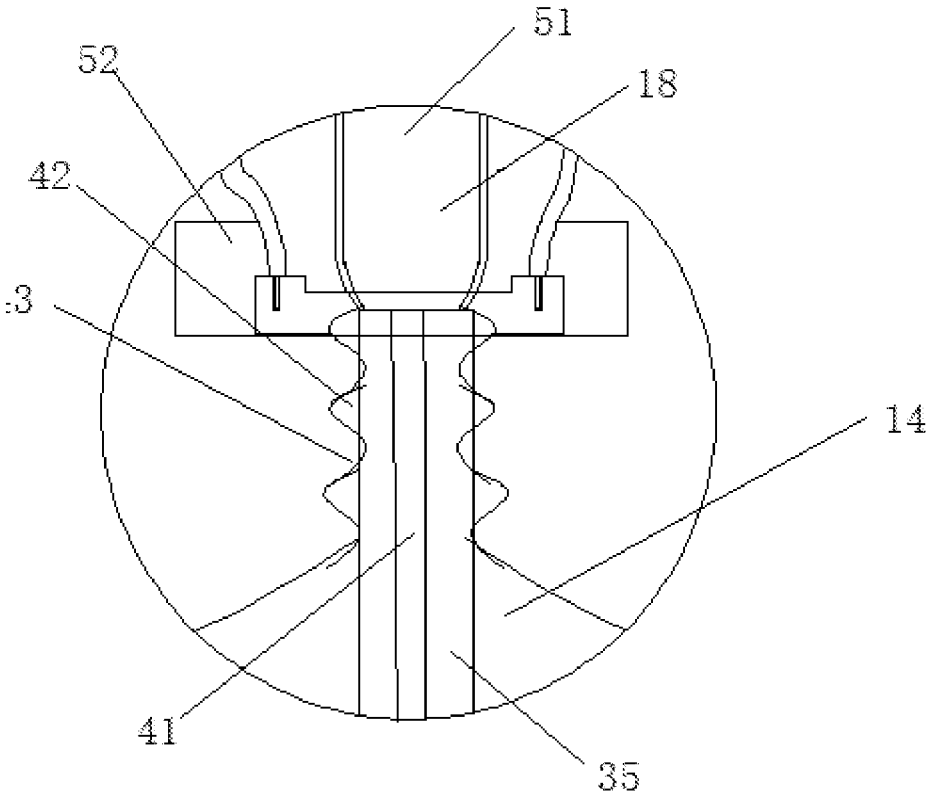
FIG. 2 is a partial enlarged view of part A in FIG. 1.
Figure 3:
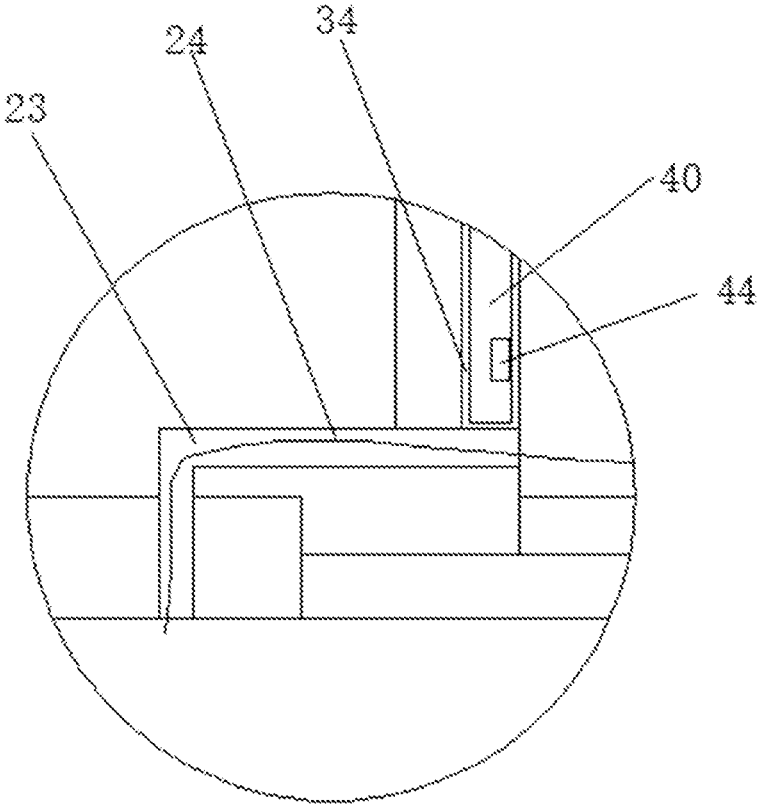
FIG. 3 is a partial enlarged view of part B in FIG. 1.
Figure 4:
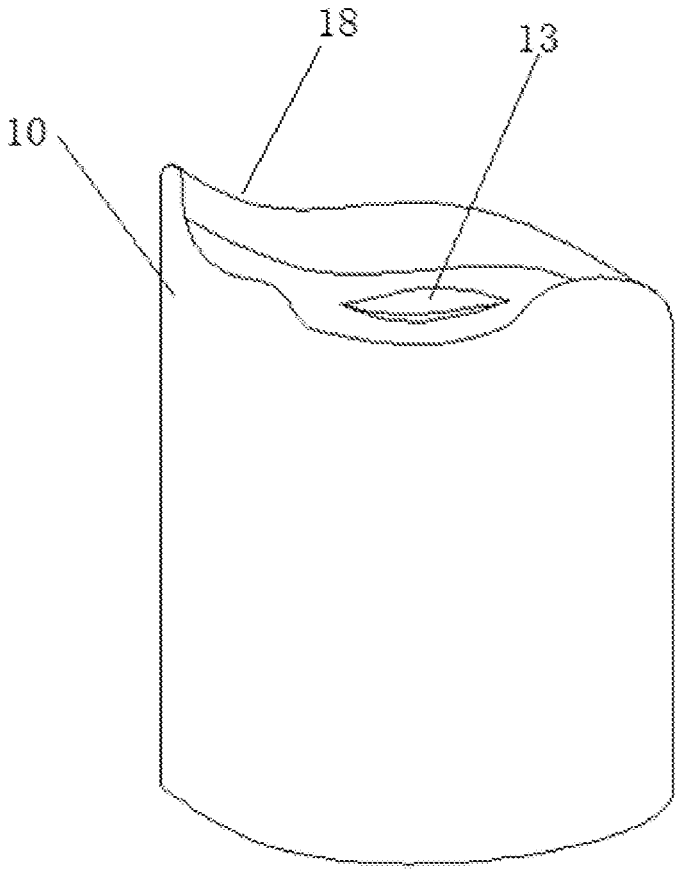
FIG. 4 is a schematic three-dimensional structural diagram of a simulated casing with a simulated wax oil layer being hidden of the present invention.
Figure 5:
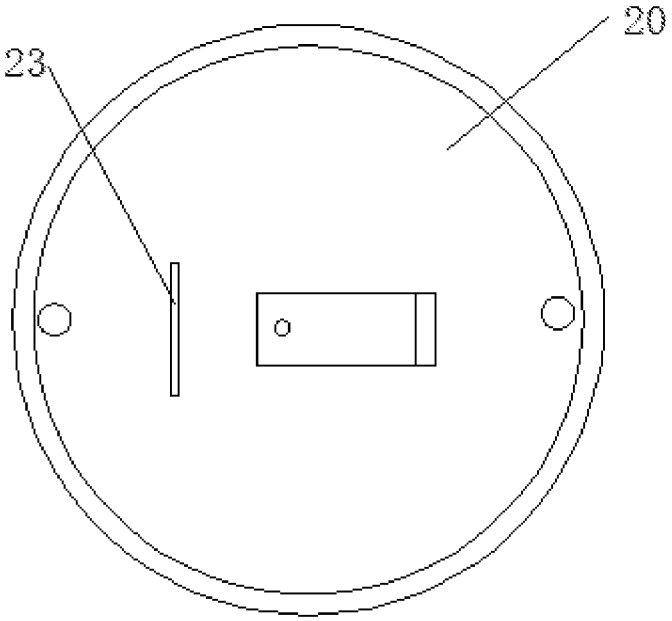
FIG. 5 illustrates a schematic structural diagram of a bottom plate of the present invention.
Figure 6:
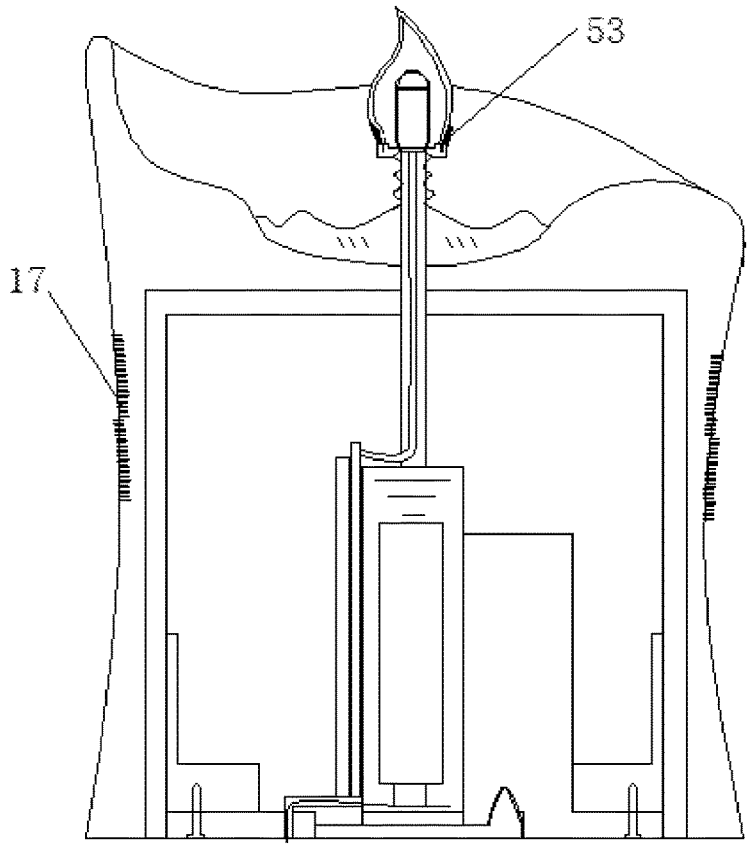
FIG. 6 is a schematic cross-section structural diagram of an anti-slip sticker in FIG. 1 replaced with an anti-slip groove.

10. simulated casing, 11. first cavity, 12. first connecting piece, 13. first groove, 14. simulated wax oil layer, 15. second groove, 16. anti-slip sticker, 17. anti-slip groove, and 18. undulating edge;

20. bracket assembly, 21. bottom plate, 22. second connecting piece, 23. switch channel, and 24. plastic sheet;

30. battery holder, 31. second cavity, 32. conductive spring, 33. conductive gasket, and 34. slot, 35. wick conduit;

40. circuit board, 41. wick wire, 42. simulated burnt layer, 43. wrinkle, and 44. boost chip; and

50. flame front, 51. luminous body, 52. light blue plastic band, and 53. light blue paint layer.

DETAILED DESCRIPTION OF THE EMBODIMENTS

The preferred embodiments of the present invention will be described below with reference to the accompanying drawings. The following descriptions with reference to the accompanying drawings are provided to assist in the understanding of the embodiments of the present invention as defined by the claims. It includes various specific details to assist in understanding, but these details are to be regarded as exemplary only. Therefore, those skilled in the art will recognize that various changes and modifications can be made to the embodiments described herein without departing from the scope and spirit of the present invention. Moreover, for clarity of the description, detailed descriptions of functions and constructions that are well known in the art will be omitted.

With reference to the following accompanying drawings, the present invention is further described:

A highly simulated electronic candle includes:

a simulated casing 10, internally provided with a first cavity 11, where a first connecting piece 12 is integrally formed on the inner side wall of the first inner cavity, the top of the simulated casing 10 is depressed downwards to form a first groove 13, and a simulated wax oil layer 14 is arranged in the first groove 13. The top of the simulated casing 10 has an undulating edge 18. The simulated wax oil layer 14 is made of an epoxy resin material, and the upper surface of the simulated wax oil layer 14 is flat or has undulating ripples. The side surface of the simulated casing 10 is depressed inwards to form a second groove 15. The outer surface of the second groove 15 is provided with an anti-slip sticker 16.

In the above-mentioned highly simulated electronic candle, an epoxy resin material is injected into the first groove 13. The epoxy resin material may be colorless and transparent or be translucent, or an appropriate amount of colorant may be added according to the actual color of the simulated casing 10 of the candle, such that the color of the simulated wax oil layer 14 is consistent with that of the simulated casing 10.

The upper surface of the simulated wax oil layer 14 may be flat, or may be corrugated or accumulated. Specifically, when the upper surface of the simulated wax oil layer 14 has undulating ripples or accumulations, there should be more accumulations at the wick conduit 35 near the center to simulate the situation that the wax oil slips along the wick when the wax oil drips from a real candle.

With the structure above-mentioned, the light emitted by a light source can be dimly reflected on the upper surface of the simulated wax oil layer 14 to simulate the scene when the real candle is burning, with a high degree of simulation.

Of course, in order to achieve the light source reflection effect above-mentioned, reflective materials such as sequins may also be attached to the upper surface of the simulated wax oil layer 14 to achieve the same or better technical effect.

The simulated casing 10 is usually of a columnar structure, and specifically, a cylindrical shape is used to simulate the shape of the real candle. The side wall of the simulated casing 10 may be cast with various colors of hardened resin. In this example, white hardened resin is used. In order to achieve a better use effect, generally, the wall thickness of the simulated casing 10 needs to ensure almost no light transmission, so as to simulate the solid shape of the real candle.

When the candle is burning, the heat around the candle is not completely uniform, so the candle will be more melted on one side, at which the top end is lower than that of the other side. In the present invention, a top end edge 18 of the simulated casing 10 is designed to be undulating to simulate the burning scene of the real candle.

Since the simulated casing 10 is made of a resin material, the surface of the simulated casing is relatively smooth, and the simulated casing is easy to slip off when grasped by a user. Therefore, in the present invention, the side wall of the simulated casing 10 is designed to be depressed inwards. The sides of the simulated casing 10 are depressed inwards, specifically, two opposite sides may be depressed inwards, or all the sides may be depressed inwards. When grasped, the upper part depressed inwards is supported on the hand to form a support, and is not easy to slip off.

At the same time, an an-slip sticker 16 is also pasted to the second groove 15 to prevent falling during grasping. Of course, in order to achieve the purpose of anti-slip, an anti-slip groove 17 may also be formed in the outer surface of the second groove 15.

A bracket assembly 20 is arranged in the first cavity 11. The bracket assembly 20 includes a bottom plate 21 and a second connecting piece 22 perpendicular to the bottom plate 21. The bottom plate 21 is fixedly connected to the first connecting piece 12 by a screw. A battery holder 30 is fixed to the side of the second connecting piece 22. The battery holder 30 includes a second cavity 31. The second cavity 31 is provided with a conductive spring 32 at the inner top end, and a conductive gasket 33 at the bottom. A switch channel 23 is formed in the bottom plate 21, the switch channel 23 is communicated with the second cavity 31, and a plastic sheet 24 for switching the battery holder 30 is arranged in the switch channel 23.

The bottom plate 21 above-mentioned encloses the first cavity 11 to form a closed cavity for accommodating various electrical elements. The foregoing first connecting piece 12 is L-shaped, with a vertical side integrally formed with the inner wall of the first cavity 11, and a horizontal side perpendicular to the bottom of the vertical side. The bottom plate 21 is fixed to the first connecting piece 12 by passing screw holes in both sides thereof to the horizontal side of the first connecting piece.

The conductive spring 32 and the conductive gasket 33 in the battery holder 30 form a conductive loop together with the battery.

According to the present invention, the switch channel 23 is also provided. Specifically, the switch channel 23 has two parts, one part is a vertical channel buried in the bottom plate 21, the other part is a horizontal part arranged in the first cavity 11, and the tail end of the horizontal part is flush with the junction of the battery and the conductive gasket 33. Attribute to the bendable property, the plastic sheet 24 can enter between the battery and the conductive gasket 33 along with the switch channel 23, so as to turn off a power supply. If you want to turn on the power supply again, just the plastic sheet 24 needs to be pulled out.

In one or more examples, a button battery horizontally arranged may also be used to supply power to the electronic candle. In this case, the switch channel 23 only needs a vertical channel, and the plastic sheet 24 is inserted along the switch channel 23 to realize the power off function.

Figure 7:
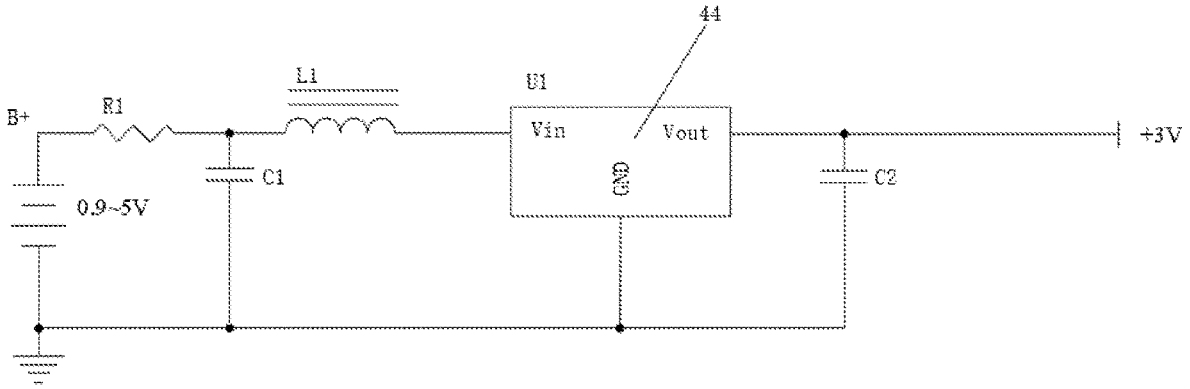
FIG. 7 is a booster circuit diagram.

The other side of the battery holder 30 is provided with a slot 34. The slot 34 accommodates the circuit board 40 for controlling a circuit. The circuit board 40 is electrically connected to the conductive spring 32. The circuit controlled by the circuit board 40 is connected into a booster circuit with a booster chip 44 (shown in FIG. 7). The booster circuit where the booster chip 44 is located holds the output voltage in the circuit above 2.2V working voltage for a long time, such that the service life and use efficiency of the battery are greatly improved under the same power consumption.

The wick conduit 35 is arranged on the top of the battery holder 30 and extends upward through the simulated wax oil layer 14. A wick wire 41 is accommodated in the wick conduit, and the wick wire 41 passes through the wick conduit 35 and is electrically connected to the circuit board 40. A flame front 50 is arranged on the top of the wick conduit 35. The flame front 50 accommodates a luminous body 51 electrically connected to the wick wire 41. The extension part of the wick conduit 35 passing through the simulated wax oil layer 14 is covered with a simulated burnt layer 42. The outer surface of the simulated burnt layer 42 has concave-convex wrinkles 43. The outer layer of the part of the bottom of the flame front 50 corresponding to the luminous body 51 is provided with a light blue plastic band 52 or coated with a light blue paint layer 53.

The present invention is provided with the wick conduit 35. Since the wick wire 41 is generally a soft wire, it cannot bear the weight of the flame front 50 and the luminous body 51 and thus falls towards a certain side. The wick conduit 35 may be made of hard resin or may also be made of metal to support the flame front 50 and the luminous body 51. The wick conduit 35 is provided with a small hole in the side of the bottom, which facilitates the wick wire 41 to pass through and be electrically connected to the circuit board 40.

The flame front 50 has a built-in cavity, and the luminous body 51 is accommodated in the cavity. Generally, an LED lamp is used to reduce the cost. At the same time, there are a light blue plastic band 52 around the bottom of the flame front 50 corresponding to the luminous body 51 to simulate the effect of a blue flame at the flame core during the burning of the real candle. Of course, in order to adapt to the environment, the light blue plastic band 52 may also be another color to adapt to the environment at that time. Of course, if the bottom of the flame front 50 is coated with a light blue paint layer 53, it can also achieve the same effect as the light blue plastic.

The place where the wick conduit 35 exposes the simulated wax oil layer 14 can be covered with black rubber to simulate the carbonization and burning of the wick of a traditional candle, which has a higher simulation degree. Since the wick is not completely smooth after burning, the black rubber layer may be lightly burnt with a flame for wrinkling to further improve the simulation degree.

The above descriptions are merely preferred examples of the present invention, and do not limit the protection scope of the present invention. For those skilled in the art, various modifications and changes can be made to the present invention. Any modifications, equivalent replacements, improvements and the like made within the spirit and principle of the present invention shall be included in the protection scope of the present invention.

What is claimed is:

1. A highly simulated electronic candle, comprising:

a simulated casing, internally provided with a first cavity, wherein a top of the simulated casing is depressed downwards to form a first groove, and a simulated wax oil layer is arranged in the first groove;

a bracket assembly, arranged at a bottom of the first cavity, wherein a battery holder with a circuit board for controlling a circuit is arranged in the first cavity, and the battery holder is electrically connected to the circuit board;

a wick conduit, arranged on a top of the battery holder and extended upwards through the simulated wax oil layer, wherein a wick wire is accommodated in the wick conduit, and the wick wire passes through the wick conduit and is electrically connected to the circuit board;

a booster circuit with a booster chip, connected into the circuit controlled by the circuit board;

an extension part of the wick conduit passing through the simulated wax oil layer covered with a simulated burnt layer, wherein an outer surface of the simulated burnt layer has wrinkles; and a flame front, arranged at a top of the wick conduit, wherein a luminous body electrically connected to the wick wire is accommodated in the flame front.

2. The highly simulated electronic candle according to claim 1, wherein a first connecting piece is fixed to an inner side wall of the first cavity;

the bracket assembly comprises a bottom plate and a second connecting piece perpendicular to the bottom plate, the bottom plate is fixedly connected to the first connecting piece, the second connecting piece is fixedly connected to the battery holder, the battery holder comprises a second cavity, and the second cavity is provided with a conductive spring at an inner top end and a conductive gasket at a bottom of the second cavity; and a side of the battery holder is provided with a slot for accommodating the circuit board, and the circuit board is electrically connected to the conductive spring.

3. The highly simulated electronic candle according to claim 2, wherein a switch channel is formed in the bottom plate, the switch channel is communicated with the second cavity, and a plastic sheet for switching the battery holder is arranged in the switch channel.

4. The highly simulated electronic candle according to claim 1, wherein the top of the simulated casing has an undulating edge.

5. The highly simulated electronic candle according to claim 1, wherein the simulated wax oil layer is made of an epoxy resin material, and an upper surface of the simulated wax oil layer is flat or has undulating ripples.

6. The highly simulated electronic candle according to claim 1, wherein an outer layer of a part of a bottom of the flame front corresponding to the luminous body is provided with a light blue plastic band or coated with a light blue paint layer.

7. The highly simulated electronic candle according to claim 1, wherein a side surface of the simulated casing is depressed inwards to form a second groove.

8. The highly simulated electronic candle according to claim 7, wherein an outer surface of the second groove is provided with an anti-slip sticker or an anti-slip groove.

* * * * *